US005655340A

United States Patent [19]

Pelsue

[11] Patent Number: 5,655,340

[45] Date of Patent: Aug. 12, 1997

[54] STABLE OPEN-SIDED SHELTER

[75] Inventor: Bradley A. Pelsue, Denver, Colo.

[73] Assignee: T.A. Pelsue Company, Englewood, Colo.

[21] Appl. No.: 340,042

[22] Filed: Nov. 14, 1994

[51] Int. Cl.[6] ..... E04B 7/16

[52] U.S. Cl. ..... 52/71; 135/87; 135/114

[58] Field of Search ..... 52/645, 71, 67, 52/118; 135/117, 87, 90, 121, 128, 143, 157, 114, 130

[56] References Cited

U.S. PATENT DOCUMENTS

| | | | |
|---|---|---|---|
| 1,449,894 | 3/1923 | Dial | 135/114 X |
| 1,744,146 | 1/1930 | Seaman | 135/143 X |
| 2,835,262 | 5/1958 | Collins | 135/121 |
| 2,863,466 | 12/1958 | Small | 135/114 X |
| 3,282,274 | 11/1966 | Scott | 135/114 X |

*Primary Examiner*—Creighton Smith
*Attorney, Agent, or Firm*—Dorsey & Whitney LLP

[57] ABSTRACT

The invention relates to a stable tent or shelter, particularly an open sided shelter, such as a hospitality test, comprising a roof and supporting legs. The roof has at least one frame for supporting a covering, the frame being provided with at least one hub and with stiff struts, the struts being hingably connected to the hub, in a plane perpendicular to the hub, and being hingable relative to the hub beyond a dead-center position, the struts being connected at their free ends with the perimeter of the covering. The shelter is characterized by a tensioning cord, for applying force to the free end of the struts in a direction perpendicular to the length of the strut and toward the center-line passing through the hub and for simultaneously connecting the free end of the roof strut, a leg associated with the strut and a roof skirt extending between adjacent struts, all of which cooperate to stabilize the shelter.

25 Claims, 6 Drawing Sheets

SHELTER SHOWN FOLDED FOR STORAGE

VIEW B-B

STABLE OPEN-SIDED SHELTER

FIELD OF THE INVENTION

The invention relates to a tent or other shelter, comprising a covering of supple, sheet-like material, such as fabric, and at least one frame for supporting the covering, the frame being provided with at least one hub and with stiff, i.e., relatively inflexible, struts. The struts are hingably connected to the hub in a plane perpendicular to the hub, are hingable relative to the hub beyond a dead center position and are connected at their free ends with the covering. The present invention is an improved, more stable structure.

BACKGROUND OF THE INVENTION

U.S. Pat. No. 3,810,482, which is assigned to the assignee of the present invention (the '482 Patent), describes a tent having the characteristics set forth in the previous section. The '482 Patent describes a collapsible tent comprising three side walls arranged at approximately right angles to each other and a top wall, i.e., a roof. Each panel consists of a rectangular or trapezoidal panel of tent fabric and a frame, connected with the covering at its corners. Each frame consists of a hub and four frame rods or struts hingable in a plane perpendicular to the hub, the frame rods or struts being hingable and collapsible to a position in which they are parallel to each other and approximately perpendicular to the hub. The struts are hingable from this position through an angle exceeding 90° from their original position and beyond a "dead center" in which the rods are in one plane. In the tent of the '482 Patent, stretchable cords are attached along the edge forming the perimeter of each panel, which cords are tied together at the corners of the panel, such that an endless loop is formed around each panel, which is constantly under tensile stress, when the tent is erected. The tent has been widely accepted in the industry for a number of reasons, including the fact that the tent is easy to erect and take down, it is compact and light weight for convenient storage and transportation, and it is durable.

Nevertheless, a significant drawback to the tent shown in the '482 Patent tent is the difficulty in stabilizing it when three or fewer panels are employed. This is particularly true in larger sizes. By tensioning the stretchable cords and tying them together, essentially only the corners of the tent cloth panel are pulled towards each other in circumferential direction, as a result of which the tent cloth between the corners will sag.

The problem is most extreme when attempting to construct a shelter using a single panel (comprising hub, struts and covering) as a roof which is supported by a number of vertical legs. Such a structure, an example of which is generally depicted in FIG. 1, is useful as a "hospitality" tent for social functions or in work environments where easy entrance to and egress from the shelter are desired. However, such a structure is quite unstable. The roof struts and vertical legs tend to twist with respect to one another, and the roof struts tend to twist with respect to the hub. In addition, there is a tendency for the hub to pass back through center resulting in the collapse of the roof frame. Various forces, such as the wind, inadvertent contact with a support leg, or other sudden forces can add to the risk of twisting and hub collapse. Such a structure is both precarious and unattractive.

As previously noted, open-sided tents are frequently used for hospitality purposes where it is desirable for people to move in and out of a tent easily on more than one side. To resolve the problems noted in the previous paragraph, caterers and others in the party rental business have resorted to using very heavy, durable components for the structure especially the legs, struts and hinges or other connecting means. Even then, the bottom of the legs or other structural elements are staked to the ground to provide further stability. Although these tents are stable, they are heavy, difficult to move and store, and require a considerable amount of time and effort to erect and disassemble. Numerous separate components are involved that can get lost or mislaid. Such tents are totally unsuited for work environments where it is highly desirable to have a stable, light weight open-sided shelter that is quickly erected and taken down and easily transported and stored.

SUMMARY OF THE INVENTION

The object of the present invention is to avoid the above-mentioned deficiencies in tents or shelters utilizing an over-center hub design such as shown in the '482 Patent. In particular, the invention provides an open-sided shelter that is quite stable, yet is light weight, compact (when collapsed) and easily erected and taken down. Because all of the components can be attached in a single integral unit, there is no risk of losing parts or pieces with frequent use. Such a shelter is useful both for hospitality purposes and for work environments, for example as a cabinet tent in the utility construction industry, where it can be erected and taken down easily and quickly while providing the appropriate protection from the elements.

I have now found that significant stability can be added to such a shelter, even when it is open-sided. This is accomplished by using a tensioning cord or strap that is attached between the end of the roof strut and an associated leg such that a force is applied to the free end of the strut in a direction perpendicular to the length of the strut and toward the theoretical "center-line" which passes through the center of hub, and a force is applied to the leg, pulling it outward from the center-line and securing it further to the strut. The connection and the forces emanating from it stabilize the shelter.

In a preferred embodiment, the shelter also includes roof skirts that extend around the perimeter of the shelter, being connected at the top of the skirt to the roof line (i.e., the perimeter of the roof covering) and the free ends of the struts. In accordance with the invention, the bottom corners of the skirts are attached to the legs by slip rings that may slide up and down on the leg. In a further preferred embodiment, the slip ring is also attached to the tensioning cord so that the forces between the leg and the free end of the strut are also applied to the roof skirt. This interaction provides further stability. To increase this interaction a portion of the tensioning cord can be attached along the edge of the skirt between the free end of the strut and the point where the skirt is connected to the slip ring.

The present invention is particularly suited for use in a tent having a roof and four open sides. In a preferred embodiment of the invention, the legs supporting the roof struts are offset from the ends of the struts. The proper tensioning force is then applied to the ends of the struts by pulling the end of the strut down and toward the leg, while simultaneously pulling the leg outward and tensioning the roof skirt. The force is applied by a tensioning cord which is attached to these components and then secured when the proper force has been applied.

The invention is further elucidated in several embodiments as depicted in the drawings.

DETAILED DESCRIPTION OF THE INVENTION AND THE PREFERRED EMBODIMENT

Figure 1:
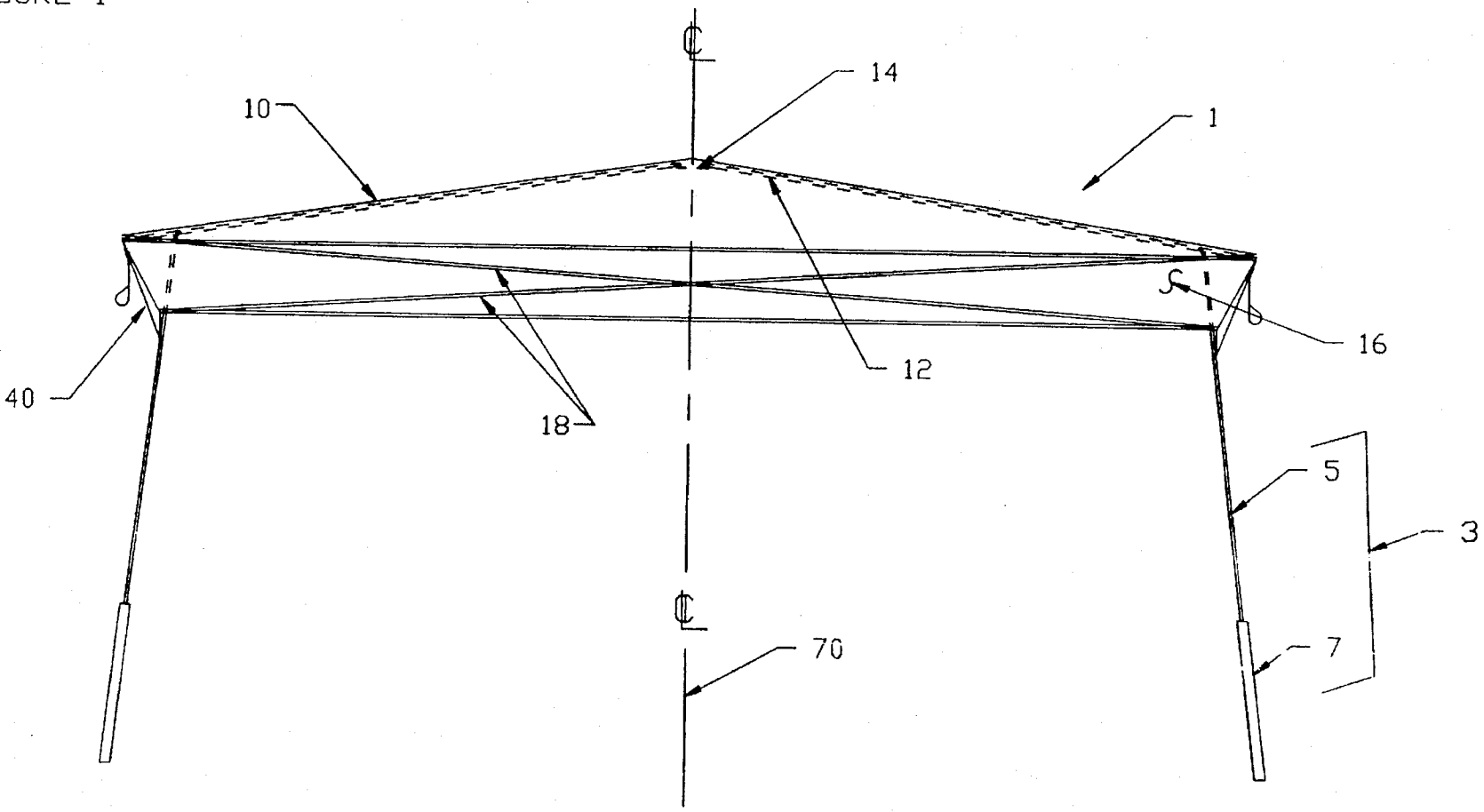
FIG. 1 is a front view of an open-sided shelter comprising one embodiment of the present invention.

The foregoing principles are incorporated in the preferred embodiment, which is illustrated in FIGS. 1–4. The shelter shown in FIG. 1 has a roof 1 and four legs 3. Each of the legs 3 comprises upper telescoping part 5 which slides into or out of the larger telescoping base 7. The telescoping permits adjustments in the height of the shelter when erected and permits the effective length of the legs to be reduced for purposes of shipment and storage of the shelter. Each leg may comprise a number of telescoping pieces or segments each of which may be secured to the adjacent telescoping segments when the tent is erected and may be released to collapse the leg at other times. The means for releasably securing the telescoping leg segments, such as thumb screws, spring-loaded bolts, etc., are well-known to one skilled in the art.

The roof 1 comprises a covering of cloth or fabric 10 and struts 12. The struts 12 extend radially outward from a hub 14 as shown in the '482 Patent and described in more detail below. Any cloth, fabric or other material of the type known to those skilled in the art may be used as the covering 10. The shelter of the present invention operates with or without the perimeter cord shown in the '482 Patent. Preferably, the covering 10 and its perimeter are slightly stretchable to facilitate movement of the hub 14 through the "dead center" position.

FIG. 1 depicts an embodiment of the invention in which the shelter also contains skirts 16 around the perimeter of the roof. As used herein, "skirt" or "roof skirt" refers to a covering which extends laterally from one strut to an adjacent strut and horizontally from the perimeter of the roof covering at the top downward to a height that does not restrict persons from entering or leaving the shelter. The skirt may be made of the same types of material as the roof covering. Typically the skirt 16 is sewn or otherwise attached to the roof covering 10 around the perimeter of the roof. The upper corners of each skirt are each attached to an adjacent strut as shown and described with respect to FIG. 2. The lower corners of each skirt are attached to the legs associated with each adjacent strut, also as shown and described with respect to FIG. 2. Finally, each of the skirts 16 contains triangular or "X"-shaped reinforcement 18 made with seams and binding or webbing to strengthen the roof skirt covering and to increase the stability of the shelter as described later. The circumferential edges of the tent roof and skirts may also be double-stitched or otherwise reinforced for stress and wear resistance.

The tent may also contain one or more walls comprising strut, hub and fabric assemblies joined together as shown in the '482 Patent. Alternatively, the shelter may have one or more fabric sidewalls which are hung from the roof or skirts and otherwise attached to the tent frame as known in the art. For purposes of present illustration, however, a completely "open-sided" tent has been utilized.

Figures 2, 2A:
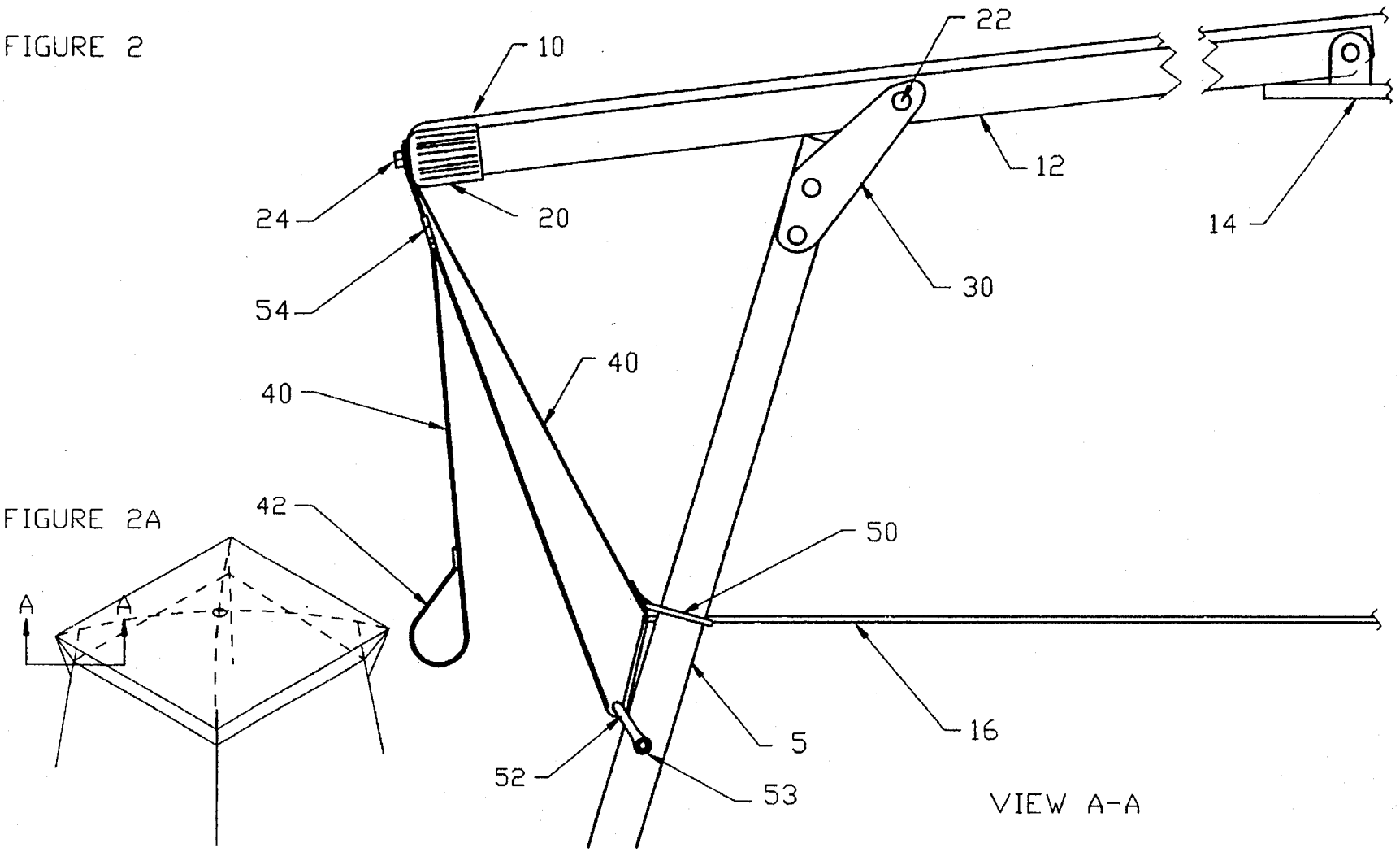
FIG. 2A is a perspective view of the shelter shown in FIG. 1.
FIG. 2 is a detailed view of one corner of the shelter shown in FIG. 1 in the erected and fully secured position. The view is taken along line A—A shown in FIG. 2A.

As used herein, the term "open-sided" refers to any shelter which has two adjacent wall openings, i.e., spaces between adjacent legs, which do not have any walls, frames or other structures which provide lateral support to the common leg and which would restrict easy access into the shelter by persons using it. The structure shown in FIG. 2A is completely, i.e., "fully," open-sided, since it has no walls. The same structure would still be open-sided if it had one wall or if it had two walls which were adjacent one another. In either case there would be at least one leg that would not be supported by a wall. The term "open-sided" does not exclude shelters which have fabric sidewalls that hang from overhead and do not provide significant lateral support to the shelter.

Figure 3A:
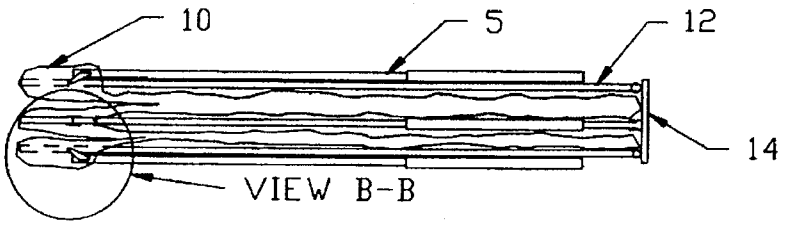
FIG. 3A shows the shelter of FIG. 1 in the collapsed and folded arrangement for storage and transportation.

The roof frame consisting of the hub 14 and struts 12 in the illustrated embodiment comprises four struts 12 which are hingable over an angle exceeding 90° in a plane perpendicular to the hub 14 from a position, in which they are parallel to each other and are substantially perpendicular to the hub 14. This is the position in which the tent is collapsed for storage as depicted in FIG. 3A. In the process of erecting the tent, the hub passes through a "dead center," i.e., the position in which the rods 12 and the hub 14 are substantially in one plane. When erected, the hub 14 extends above the struts as depicted in FIG. 1, with the struts having passed through an angle of more 90° from the collapsed position in which they were parallel to one another. This arrangement of the hub and struts is not unique. As described previously, this prior art system suffers from problems of twisting and a tendency for the hub in the erected shelter to pass back through center, causing the collapse of the tent. This is so, because there is only a slight tension of the hub outward after the struts have pivoted over dead center. As noted previously, an open-sided tent of this general design and without the improvements of this invention has a significant tendency for twisting of the struts relative to the hub and for twisting of the legs relative to the struts resulting in substantial instability.

The struts utilized in the shelter of the present invention should be strong enough to tolerate the forces applied to them and rigid enough so that a force applied to the free end of the strut will be transmitted through the rod to the hub, rather than merely resulting in flexion or bending of the strut. The term "stiff" when used herein is intended to refer to a strut meeting these basic requirements. It does not necessarily imply that the strut is totally inflexible but that it is relatively inflexible. An example of a material having these characteristic is 1-inch, outside diameter tubing of 6063 T6 aluminum. Fiberglass rods of a slightly larger size will also generally be satisfactory. However, many smaller, more flexible rods, will flex too much, resulting in instability. It should be noted that rods suitable for the purposes of the struts and legs in shelters embodying the present invention are much smaller and lighter than the poles typically utilized in conventional hospitality tents as described previously.

One suitable hub for use in the invention is depicted in detail in FIG. 4. The hub 14 consists of a base plate 61 which is generally circular in shape having a hole 66 in the center for mounting of the covering and through which a handle, strap, knob or other device for griping the hub can be attached for convenience in causing the hub to pass over dead center when the tent is erected or "taken down." The hub has four mounting brackets 64 on top of the base plate 61 to receive the ends of the struts 12, only one of which is shown as an example in FIG. 4. The end of strut 12 is mounted in the bracket with a bolt or rivet 68 which passes through the mounting bracket and a corresponding hole in the strut.

There are two important qualities for a suitable hub of the present invention. First, it should be designed in a way that restricts the strut from moving horizontally or twisting in the socket. This prevents twisting of the struts which will result in similar twisting and distortion of the legs. For this reason a typical ball and socket mounting would not be suitable. Instead, it is preferred to use a mounting which only permits the hinged movement of the strut necessary for erecting and collapsing the tent and no other. For example, in the hub shown in FIG. 4 a bolt or rivet passes through the entire cross section of the strut 12 and mounting brackets 64, which should be barely wider than the strut to prohibit rotation or twisting of the strut relative to the hub.

Second, the hub should limit further hinged movement of the strut relative to the hub after the hub has passed over dead center to the erected position. This is important because it ensures that a force applied to the free end of the strut will be transmitted against the hub. For example, in the hub shown in FIGS. 2 and 4, the strut is limited in its motion by its contact with the base of the plate 61. This is shown in the side view of the hub and strut in FIG. 4B in which the strut is depicted in a position in which its further movement is limited by the fact that the bottom of the strut 12 near the end where it is mounted on the bracket 64 strikes the edge of the base plate 61 at the position identified on the drawing as 67. Any other appropriate means by which the force on the end of the strut can be directed against the hub could be utilized.

As a point of reference, FIG. 1 also shows a vertical, i.e., dashed, hypothetical "center-line" 70 which is perpendicular to the hub and passes through its center.

FIG. 2, is a more detailed illustration of certain components in one specific embodiment of the present invention. The strut 12 has a cap 20, which is located at the "free end" of the strut, i.e., the end distant from the one mounted on the hub 14, and is tightly secured to the end of the strut by means known in the art. Cap 20 is intended to provide a smooth covering for the end of the strut so that it does not cause undue wear on the covering which comes in contact with it. In addition, roof covering 10 is connected to the free end of the strut by a screw or bolt 24 which holds it in place. The same screw or bolt also secures the upper corners of two adjacent roof skirts 16 where they meet at the free end of the strut. Bottom corners of the same adjacent skirts are also attached to retainer slip collar ring 50 which can move up and down leg 3 as described later.

Figure 3:
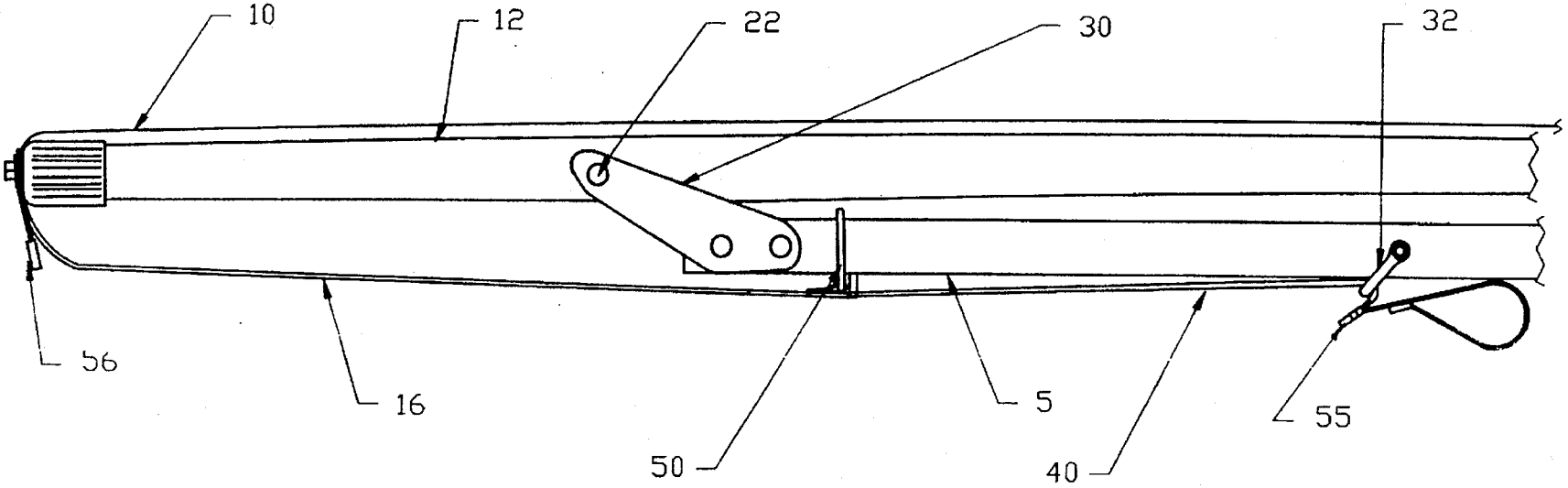
FIG. 3 is a view of the same corner of the shelter shown in FIG. 2 in the collapsed and folded position. It is taken along line B—B in FIG. 3A.
Figures 4A, 4B:
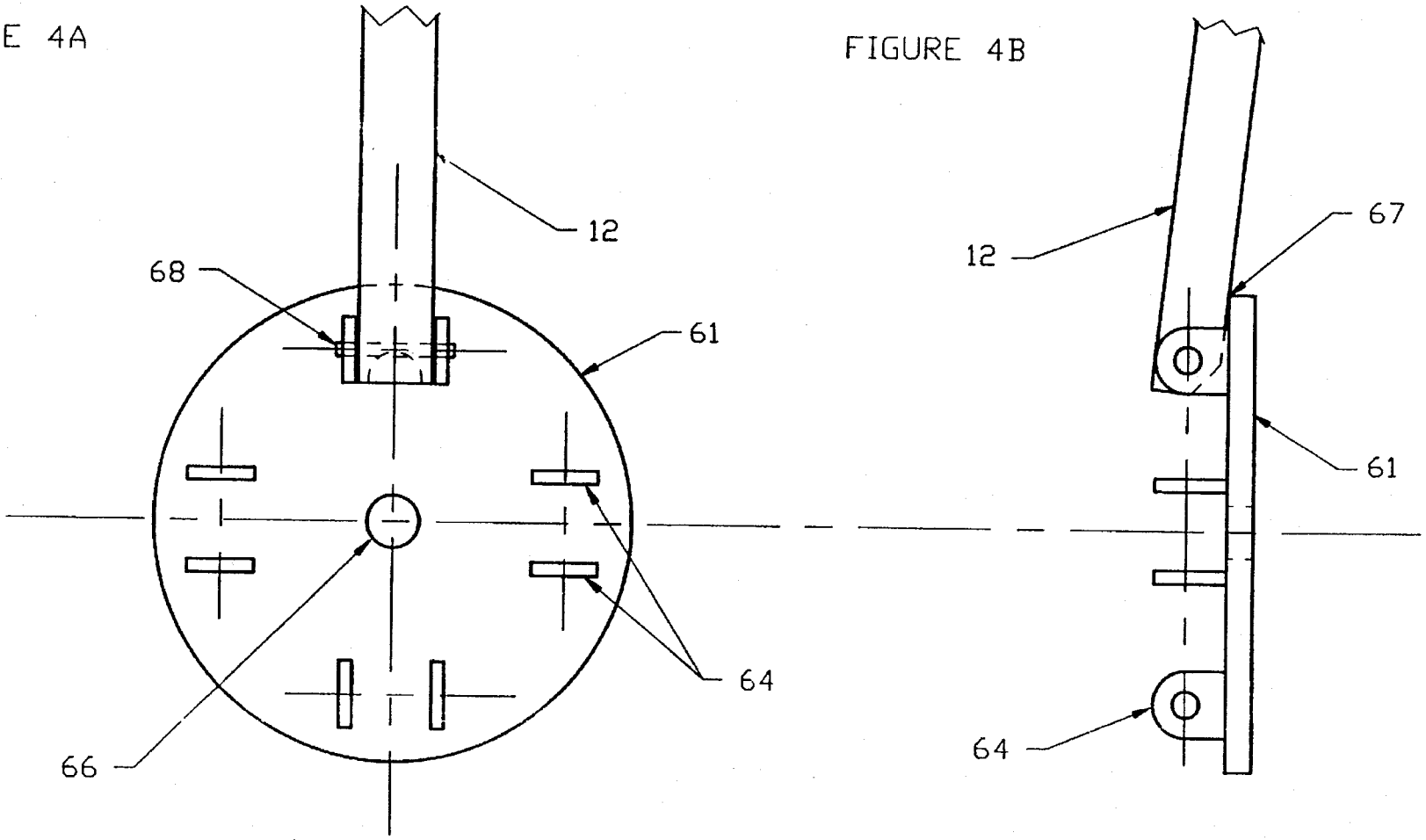
FIG. 4A is a drawing depicting the top of a hub.
FIG. 4B is a side view of the same hub suitable for use in shelters of the present invention.

The top piece 5 of leg 3 is attached to the strut by bracket 30. As depicted in FIG. 2, leg piece 5 extends into a socket in the bracket where it can be secured by screws or other fastening means well known to one skilled in the art. The bracket 30 is attached to the strut 12 at pivot point 22. The bracket can be rotated in a direction (i.e., counter-clockwise, as depicted) so that the leg can be moved parallel to and adjacent the strut in the collapsed position as shown in FIGS. 3 and 3A.

Finally, bolt 24 also secures one end of a tensioning strap 42 to the free end of the strut. In the embodiment shown in FIG. 2, the tensioning strap is also sewn along the vertical edge of the two adjacent roof skirts 16 where they meet at this corner of the tent. This provides a secure edge for the skirts and permits greater control over their shape when the tensioning member is tightened and secured. Alternatively, the tensioning strap 42 may be deployed separate from, rather than sewn or otherwise attached, along the edge of the skirts. Although the tensioning means can be attached to the leg 3 at various points, it is preferred that the tensioning strap 42 be attached to the slip collar ring 50 on leg 3. This forms a connection which is important to the invention, since it enables the free end of the strut 12, the leg, and the roof skirt to be tensioned with respect to one another.

In the preferred embodiment of the invention, the tensioning strap is also attached through a C-shaped shackle 52 that is bolted to the leg 3 with shackle bolt 53. Shackle 52 is located on the leg 3 at a point below the maximum extent of the bottom of the roof skirt 16 where it is attached to slip collar ring 50 on the leg. This assures that when the tensioning cord 40 is tightened, a force is applied not only between the leg 3 and the free end 20 of the strut, but also in a direction pulling the slip collar ring 50 and the corner of roof skirt 16 downward along the leg 3. The relationship of these parts provides maximum stability to the shelter.

In one embodiment of the invention, the tensioning cord 40 can be tightened and then "tied-off" at the shackle 52. In the preferred embodiment depicted in FIG. 2, the shackle acts as a pivot, since the tensioning cord extends back or returns to the free end 20 of the strut 12, where it is looped through a side release clip 54 and then hangs vertically downward. The male part 56 of the side release clip 54 is also attached to the end 20 of strut 12 by bolt 24. The side release clip is of a design known in the art which can securely engage the two sections of the cord 40 which extend between the free end of the strut 20 and the leg 3 so that they do not slip, once the proper tension has been supplied, and can be released to permit the cord sections to separate from one another. A typical side release clip 54 comprises male part 56 and female part 55 which can be releasably snapped together. The clip also contains a slide release, i.e., "ladder lock," which can be utilized to change the effective length of the tensioning cord between the end of the strut 20 and the leg 3 thereby determining the amount of tension that is applied. Preferably, the free end of the tensioning cord 40 has a loop, handle or other means 42 to make it easier to grasp.

To erect the shelter, the collapsed device is removed from its carrying bag. The hub is pushed through "dead center" to the erected position. Enough tension is put on the hub by the perimeter hem of the fabric adequate to hold the roof in position until the first tension strap on one of the leg/strut assemblies is tightened. The legs are folded out. The roof is raised overhead, permitting the legs of the shelter to extend downward. The user can then buckle the male and female parts, 56 and 55, of the side release clip 54 together. The hand loop of the tensioning cord is then pulled to tension the free end of the strut, the tensioning cord is secured in the ladder lock so that it maintains tension on the free end of the strut. This same procedure is repeated for the other three legs.

The tightening of the tensioning cord has a number of effects on the shelter. First, it applies a force to the free end 20 of strut 12 in a direction perpendicular to the strut and toward the center-line of the hub. The strut, which pivots around point 22, transmits this force to the other end of the strut, which because of its contact with the base 61 of the hub 14, applies an upward pressure on the hub 14. This adds stability to the roof, by preventing twisting and by causing the hub to become more resistant to pressures which might cause its movement downward through "dead center" resulting in the collapse of the tent. In addition, the tensioning cord causes the leg 3 to be pulled outward. The movement of the base 7 of the leg outward from the point of connection of upper leg portion 5 to the strut at 22 adds stability. The fact that there is a tighter connection between the leg and the free end of the strut also has this effect. Finally, the tensioning cord pulls the slip ring and the corners of the roof skirts downward, all of which also increase the stability of the leg. Because two adjacent roof skirts are attached to the same slip ring at right angles, they significantly restrict and limit full outward movement of the leg. For this reason, it may be desirable to reinforce the material in the roof skirts 16 by diagonal strips 18 as shown in FIG. 1.

As shown in FIG. 2, the bracket 30 is designed internally to abut the strut 12, so that the movement of the leg in the opposite direction (i.e., clockwise, as depicted) is restricted. When the tensioning cord is tightened, it applies a force on the end of the strut perpendicular to the strut and towards the theoretical center-line through the hub. This causes the strut 12 to pivot around point 22. This pivoting action is-assisted if, as shown in FIG. 2, the bottom of the strut 12 contacts or "bottoms out" against the top of the leg 3. Although this construction is the preferred embodiment, as shown in FIG. 2, the same result can be achieved by other means. In fact, it may not be necessary for the bottom of the strut 12 to contact the top of the leg 3. In that regard, it should be noted that outward movement of the leg relative to the strut past a certain alignment is restricted by the slip ring which is connected to adjacent roof skirts at a 90° angle to one another.

It should be noted that bracket 30 and leg 5 are attached to strut 12 at pivot point 22, so that the leg is offset from the end 20 of the strut toward the center-line through the hub. The pivot point 22 should be positioned at a distance from the free end of the strut sufficient amount to obtain the proper mechanical advantage when tension is applied to the tensioning means, without resulting in interference of the leg with the internal use of the tent if sidewalls are hung.

The same construction shown in FIG. 2 should be applied to other struts around the hub so that equivalent forces are supplied symmetrically around the hub pushing the hub uniformly upward. Preferably, in the four-strut fully open-sided embodiment shown in the drawing, the free end of each strut should have an appropriate tensioning device. However, if more than four struts are utilized, it may be possible to symmetrically apply the forces to the hub utilizing less than all of the struts. In general, however, it is desirable to apply the principles of the invention to each strut.

FIG. 3 illustrates the same corner of the shelter shown in FIG. 2, but in the arrangement in which the shelter is collapsed for storage or shipment. To take down the shelter, the tension on strap 40 is reduced, by first relaxing the strap between the clip and the shackle 52 on leg 5 by releasing the ladder lock. This removes the force tensioning strut end 20, which likewise releases the upward force on hub 14. It also prepares the tensioning cord for proper attachment during erection of the shelter as previously described. The male and female parts of the side clip can then be unlocked from one another to fully release the tension. This procedure is followed on the remaining three corners. When tension has been fully released on all four legs, the legs can be folded relative to the struts, but the roof will still be under tension from the perimeter of the roof until the hub is pulled or pushed back over center. In the collapsed position the legs 5 are parallel to one another and perpendicular to the hub. The covering can then be folded around the straps to form a compact collapsed shelter as shown in FIG. 3A. As noted previously, FIG. 3 is a view taken along line B—B in FIG. 3A. The overall stored length of the shelter is the length of a strut plus a nominal additional amount to accommodate the hub and loose fabric. The entire shelter can be placed in a bag for easy storage and shipment.

As illustrated by the drawings and the foregoing description, shelters of the present invention have a number of advantages. They are quite stable. They are light weight and do not require the heavy materials and components utilized in the prior art. They do not require staking to the ground under moderate conditions. They exhibit appropriate exterior roof lines which avoid puddling and the problems associated with it. All of the parts are integral, minimizing the risk of lost parts or pieces that are important to the performance of the shelter. Shelters of the invention are easily erected and taken down. They can be collapsed into a package of minimum dimensions and weight to facilitate storage and shipment.

Figure 5:
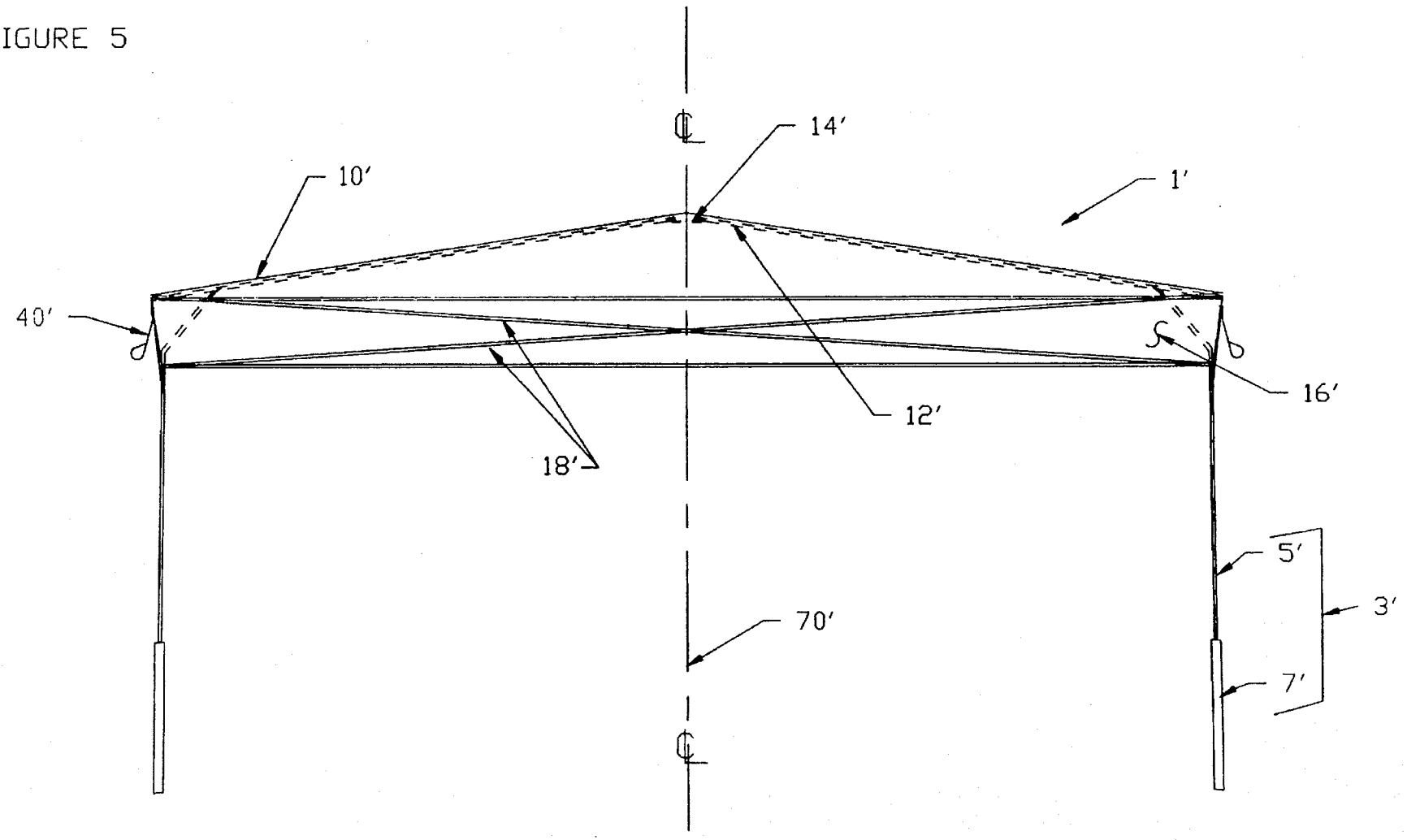
FIG. 5 shows another embodiment of the present invention in which the leg and strut are constructed to maximize usable interior space under the roof when sidewalls are employed.
Figures 6, 6A:
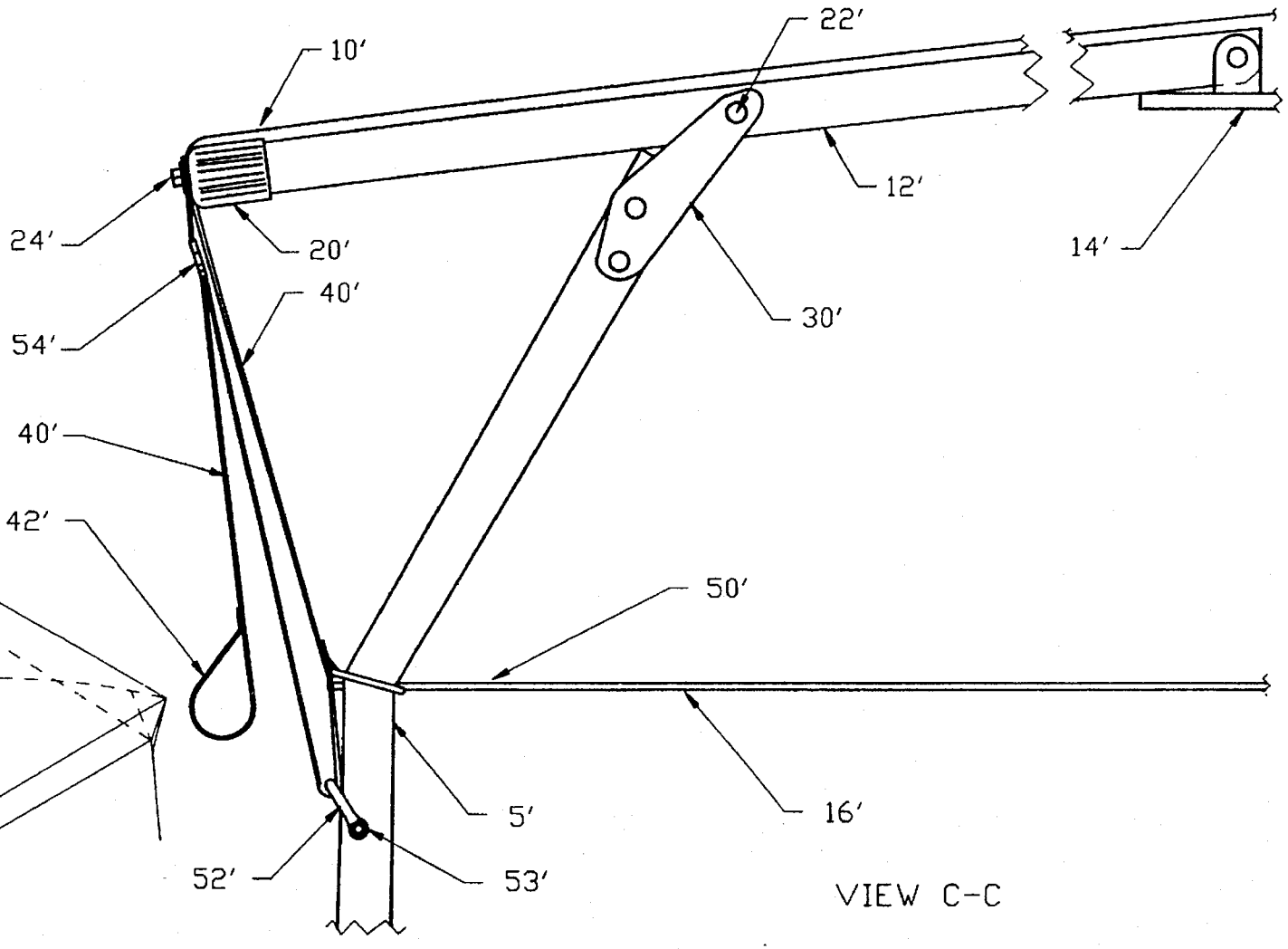
FIG. 6A is a perspective view of the shelter shown in FIG. 5.
FIG. 6 is a more detailed view of one corner of the shelter shown in FIG. 5 in the erected and fully secured position. It is taken along line C—C in FIG. 6A.

A slightly modified embodiment of the present invention is shown in FIGS. 5, 6A and 6. Like parts are given numbers identical to those in FIGS. 1 through 4, with the addition of a "prime" to distinguish them. The basic elements of the shelter are the same, except that instead of being straight, the top of the legs 3' in FIGS. 5, 6A and 6 are bent slightly toward the center-line. This offset, minimizes interference which the leg 3 in FIGS. 1–4 might cause to the hanging of sidewalls. This maximizes the usable area under the roof of the shelter in situations where it is desirable to hang sidewalls to provide protection from the elements.

The description and examples set forth herein are intended to illustrate representative embodiments of the invention. For example, the principles of the invention may be applied to open-sided shelters having multiple roof hubs or frames. The number of struts utilized may vary depending upon the desired shape and design of the shelter. The claims which follow are not intended to be limited to the specific disclosed embodiments. The invention is susceptible to modification, variation and change without departing from the proper scope or fair meaning of the following claims.

I claim:

1. A collapsible open-sided shelter comprising:

a covering of supple, sheet-like material, a frame stretching the covering and legs supporting the frame and covering as a roof;

said frame being provided with at least one hub having a center-line perpendicular to the hub and passing through its center and with stiff struts extending radially outward from said hub away from the center-line, each of said struts having a free end distant from the hub and connected to said covering;

said struts being hingably connected to the hub so that the struts may move in a plane perpendicular to the hub and to a limited position relative to the hub beyond dead center;

a number of said struts each being hingably attached to an associated leg; and tensioning means for applying a tensioning force to a number of said struts symmetrically located around said hub and the leg associated with each said strut, said tensioning force being applied to the free end of the struts in a direction toward the center-line so that the hub continues to be forced past dead center, and said tensioning force being applied to the leg associated with the strut in a direction pulling the leg outward from the center-line.

2. The shelter of claim 1 in which each strut is supported by a leg which is associated with said strut.

3. The shelter of claim 2 in which each of said legs is offset from the free end of the associated strut.

4. The shelter of claim 2 in which each of said legs is offset from the free end of the associated strut in a direction toward the center-line.

5. The shelter of claim 1 further characterized by the fact that the shelter is fully open-sided.

6. The shelter of claim 4 which further comprises roof skirts also made of a supple, sheet-like material, which extend downward from the roof covering between adjacent struts, said roof skirts having a top section and a bottom section, said roof skirts being attached at the top section to the free ends of the adjacent struts and at the bottom section being attached to the leg associated with each adjacent strut by attaching means that can move up and down along a portion of said leg, said attaching means being connected to the tensioning means in a manner to provide a downward tensioning force to the attachment means and the roof skirts.

7. The shelter of claim 6 in which the tensioning means comprises a strap connecting the free end of the strut, the attaching means and the leg associated with said strut at a point below said attaching means.

8. The shelter of claim 7 in which said legs comprise telescoping parts that are extendable to support the frame when the shelter is erected and are retracted into one another to facilitate shipment and storage of the shelter.

9. The shelter of claim 8 in which said roof skirts are reinforced diagonally.

10. A collapsible open-sided shelter comprising:

a covering of supple, sheet-like material, a frame stretching the covering and legs supporting the frame and covering as a roof;

said frame being provided with at least one hub having a center-line perpendicular to the hub and passing through its center and with stiff struts extending radially outward from said hub away from the center-line, each of said struts having a free end distant from the hub and connected to said covering;

said struts being hingably connected to the hub so that the struts may move in a plane perpendicular to the hub and to a limited position relative to the hub beyond dead center;

a number of said struts each being hingably attached to an associated leg;

a skirt connected to the roof of the shelter and also being connected to the free ends of the struts;

attaching means for attaching the skirt to each of said legs and to permit movement of the skirt relative to each leg; and tensioning means for applying a force to a number of said struts symmetrically located around said hub, to the leg associated with each strut and to the means for attaching the roof skirt to said leg, said tensioning force being applied to the free end of the strut in a direction toward the center-line so that the hub continues to be forced past dead center, said tensioning force being applied to the leg associated with the strut in a direction pulling the leg outward from the center-line, and said force being applied to the attaching means in a downward direction to tension the skirt.

11. The shelter of claim 10 further characterized by the fact that it is fully open-sided.

12. The shelter of claim 11 in which the attaching means constitutes a slip ring.

13. The shelter of claim 12 in which the tensioning means constitutes a strap.

14. The shelter of claim 13 which further includes a shackle mounted to the leg below the slip ring, and the tensioning means constitutes a strap extending from the free end of the strut to the slip ring, then to the shackle and then back to the free end of the strut.

15. The shelter of claim 14 further including a side clip connecting and disconnecting the strap and adjusting its effective length.

16. A collapsible open-sided shelter comprising:

a covering of supple, sheet-like material, a frame stretching the covering and legs supporting the frame and covering as a roof;

said frame being provided with at least one hub having a center-line perpendicular to the hub and passing through its center and with stiff struts extending radially outward from said hub away from the center-line, each of said struts having a free end distant from the hub and connected to said covering;

said struts being hingably connected to the hub so that the struts may move in a plane perpendicular to the hub and to a limited position relative to the hub beyond dead center;

each of said struts being hingably attached to an associated leg which is offset from the free end of said strut;

a skirt connected to the roof of the shelter and also being connected to the free ends of the struts;

attaching means for attaching the skirt to the leg associated with each strut, said attaching means being movable relative to the leg; and tensioning means connecting the free end of the strut to the attaching means and to said leg at a point below the attaching means, said tensioning means tensioning the free end of the strut, the leg and the attaching means and skirt with respect to one another.

17. The shelter of claim 16 further characterized by the fact that it is fully open-sided.

18. The shelter of claim 17 in which the attaching means constitutes a slip ring.

19. The shelter of claim 18 in which the tensioning means constitutes a strap.

20. The shelter of claim 19 which further includes a shackle mounted to the leg below the slip ring and the tensioning means constitutes a strap extending from the free end of the strut to the slip ring, then to the shackle and then back free end of the strut.

21. The shelter of claim 20 in which a portion of the strap is attached to said skirt.

22. The shelter of claim 21 further including a side clip connecting and disconnecting the strap and adjusting its effective length.

23. The shelter of claim 21 in which the skirt is reinforced diagonally.

24. The shelter of claim 22 in which said legs comprise telescoping parts that are extendable to support the frame when the shelter is erected and are retractable into one another to facilitate shipment and storage of the shelter.

25. The shelter of claim 22 in which the hub includes means for restricting the struts from twisting or moving laterally.

* * * * *